US006131537A

United States Patent [19]

Carr

[11] Patent Number: 6,131,537

[45] Date of Patent: Oct. 17, 2000

[54] WATER-COOLED BAFFLE FOR A FURNACE

[75] Inventor: Hugh B. Carr, McMurray, Pa.

[73] Assignee: Bricmont, Inc., Cannonsburg, Pa.

[21] Appl. No.: 09/418,354

[22] Filed: Oct. 14, 1999

Related U.S. Application Data

[60] Provisional application No. 60/155,020, Sep. 21, 1999.

[51] Int. Cl.[7] ..... F22B 15/00

[52] U.S. Cl. ..... 122/188; 122/44.2; 122/62; 122/235.17; 432/77; 432/81

[58] Field of Search ..... 122/44.2, 61, 62, 122/63, 65, 188, 235.17; 432/77, 81, 116, 173, 233

[56] References Cited

U.S. PATENT DOCUMENTS 4,633,821 1/1987 Cleer, Jr. ..... 122/44.2

5,586,547 12/1996 Nixon ..... 122/44.2

*Primary Examiner*—Denise L. Ferensic
*Assistant Examiner*—Gregory A. Wilson
*Attorney, Agent, or Firm*—Clifford A. Poff

[57] ABSTRACT

A water-cooled baffle used in a furnace to control the clearance gap between the bottom of the baffle and the hearth of the furnace. The baffle includes a first pipe that extends at least to the walls of the furnace and serves as an arbor to allow rotation of the baffle. The first pipe has cooling water entry and water exit ports at opposing ends, and a plate and core buster segments disposed inside of it to establish annular regions for water flow. A second pipe is connected to the first pipe in a manner to allow the flow of water from the annular region connected to the water entry port of the first pipe, through the second pipe, and then through the annular region connected to the water exit port of the first pipe.

19 Claims, 7 Drawing Sheets

WATER-COOLED BAFFLE FOR A FURNACE

CROSS-REFERENCE TO RELATED APPLICATIONS

This application claims benefit of Provisional Appl. 60/155,020 filed Sep. 21, 1999.

BACKGROUND OF THE INVENTION

1. Field of the Invention

The present invention relates to a water-cooled baffle used in a furnace to regulate a gas flow space between the baffle and the hearth of the furnace.

2. Description of Related Art

Control of gas direction between furnace heating zones, and/or charge or discharge sections, in a high temperature (typically at an operating temperature of about 2200° F.) rotary heart furnace is an important factor relative to the efficiency of the furnace. The exercise of such control by a moveable baffle requires that the baffle either be constructed to operate at the prevailing temperature in the furnace chamber or thermally protected to prevent damage to the structure of the baffle. When thermal protection uses a circulating coolant, the release of heat from the coolant externally of the furnace adversely effects the efficiency of the furnace and therefore, it is desired to minimize this furnace heat loss.

In the present invention, an arrangement of interconnected water-cooled pipes is used to form a baffle between adjacent zones or sections of a furnace. The position of the baffle can be adjusted by angular rotation of one of the water-cooled pipes that serve as the damper shaft. Rotation of the water-cooled pipe, and therefore, the baffle, will adjust the gas flow space in the form of a clearance or gap between the baffle and the hearth of the furnace. Waste gasses pass through this gap from one zone, or section, of the furnace to another. Consequently, a variable resistance to the waste gas flow can be provided by adjusting the position of the baffle, and proper waste gas direction is achieved to maximize fuel efficiency in the furnace and to effect a better control of system pressure within the furnace. In direct reduction furnaces, product quality can be improved through the use of this device by its limiting of charging area oxygen (air) from entering the discharge area where product reduction has already taken place.

It is an object of the present invention to provide a relatively inexpensive apparatus for achieving gas flow control between furnace zones or sections.

It is another object of the present invention to provide apparatus for achieving gas flow control between sections, or zones, in high temperature furnaces.

It is a further object of the present invention to provide a fluid cooled baffle to control gas direction in a high temperature furnace and minimize the loss of furnace heat.

BRIEF SUMMARY OF THE INVENTION

More particularly according to the present invention there is provided a fluid-cooled baffle having a first hollow element, or first pipe, that has a fluid entry port at its first end, and a fluid exit port at its second end. A plate is inside the first pipe to block the flow of fluid such as water or other cooling medium, through the first pipe. A first core buster segment is positioned inside the first pipe, between the fluid entry port and the first side of the plate, to form a substantially annular first region between the inside surface of the first pipe and outside surface of the first core buster segment. A second core buster segment is positioned inside the first pipe, between the fluid exit port and the second side of the plate, to form a substantially annular second region between the inside surface of the first pipe and outside surface of the second core buster segment. A duct such as a second pipe has a first end connected to a first opening in the first pipe. The first opening is located between the fluid entry port and the first side of the plate, preferably in the vicinity of the plate. The second end of the duct is connected to a second opening in the first pipe. The second opening is located between the fluid exit port and the second side of the plate, preferably in the vicinity of the plate. With this arrangement, cooling fluid enters the fluid entry port of the first pipe and flows through the substantially annular first region for a predetermined minimum flow of fluid and then through the first opening into the duct. The fluid path continues out of the duct through the second opening, and into the substantially annular second region for a predetermined minimum flow of fluid therein. Fluid then exits the first pipe at the fluid exit port. At least two rows of baffle skirt plates can be provided at the bottom of the duct to impart turbulence to the flow of gases passing the baffle in the furnace. Each row of skirt plates can be made up of a plurality of short length plates that are spaced apart from each other. Generally, the duct takes the form of a second pipe having a smaller internal diameter than the internal diameter of the first pipe.

According to a further aspect of the present invention, the duct or second pipe consists of multiple end and longitudinal segments. A first end segment has its axis disposed at an angle to the axis of the first pipe. The first end of the first end segment is connected to the first opening in the first pipe. A first longitudinal segment has its axis substantially parallel to the axis of the first pipe. The first end of the first longitudinal segment is connected to the second end of the first end segment. A second end segment has its axis positioned at an angle to the axis of the first pipe. The first end of the second end segment is connected to the second end of the first longitudinal segment. A second longitudinal segment has its axis substantially parallel to the axis of the first pipe and is situated between the first pipe and the first longitudinal segment of the second pipe. The first end of the second longitudinal segment is connected to the second end of the second end segment. A third end segment has its axis positioned at an angle to the axis of the first pipe. The first end of the third end segment is connected to the second opening in the first pipe, and the second end of the third end segment is connected to the second end of the second longitudinal segment.

The present invention also provides a fluid-cooled baffle for controlling the flow of hot gases in a clearance or gap between the baffle and the hearth of a furnace. The baffle includes a first hollow element, or first pipe, that has a fluid entry port and a fluid exit port at opposite ends. The first pipe is substantially horizontally disposed below the roof of the furnace and extends at least to the opposing walls of the furnace. A plate is located inside of the first pipe to block the flow of fluid through the first pipe. A first core buster segment is positioned inside of the first pipe, between the fluid entry port and the first side of the plate, to form a substantially annular first region for a predetermined minimum flow of fluid between the inside surface of the first pipe and outside surface of the first core buster segment. A second core buster segment is positioned inside of the first pipe, between the fluid exit port and the second side of the plate, to form a substantially annular second region for a predetermined minimum flow of fluid between the inside surface of the first pipe and outside surface of the second core buster segment. A duct such as a second pipe has a first end connected to a first opening in the first pipe. The first opening is located between the fluid entry port and the first side of the plate, preferably in the vicinity of the plate. The second end of the duct is connected to a second opening in the first pipe. The second opening is located between the fluid exit port and the second side of the plate, preferably in the vicinity of the plate. The duct traverses substantially at least twice the width of the furnace. With this arrangement, cooling fluid enters the fluid entry port of the first pipe and flows through the substantially annular first region and then through the first opening into the duct. The fluid path continues out of the duct through the second opening, and into the substantially annular second region. Fluid then exits the first pipe at the fluid exit port. At least two rows of baffle skirt plates can be provided at the bottom of the duct. Each row of skirt plates can be made up of a plurality of short length plates that are spaced apart from each other. When the duct has a form of a second pipe, the internal diameter of the second pipe is smaller in diameter than the internal diameter of the first pipe. Means can be provided to rotate the first pipe, and thereby rotate the baffle, to adjust the clearance or gap between the bottom of the baffle and the hearth of the furnace. The rotational means can be a lever connected to the first pipe. Alternatively, automatic means can be provided to rotate the first pipe. A layer of thermal insulation adhered to the outer face surface of the baffle advantageously provides a thermal barrier against degradation of the baffle during operation in the furnace.

BRIEF DESCRIPTION OF THE SEVERAL VIEWS OF THE DRAWINGS

For the purpose of illustrating the invention, there is shown in the drawings a form which is presently preferred; it being understood, however, that this invention is not limited to the precise arrangements and instrumentalities shown.

FIG. 3(*a*) is a sectional view similar to FIG. 3 and illustrating a further embodiment of a water-cooled baffle provided with a layer of thermal insulation according to the present invention.

FIG. 4(*b*) is a detail of the water-cooled baffle of the present invention as installed in the furnace shown in FIG. 4(*a*).

DETAILED DESCRIPTION OF THE INVENTION

Figure 1:
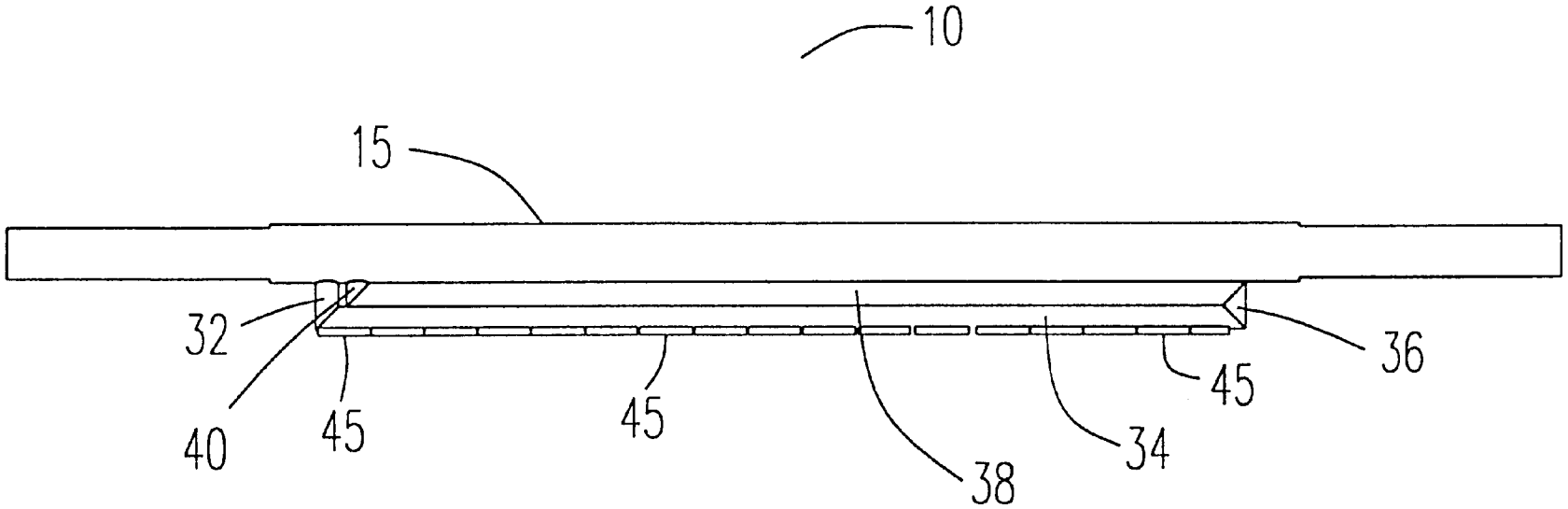
FIG. 1 is a plan view of one embodiment of the water-cooled baffle of the present invention.
Figure 2:
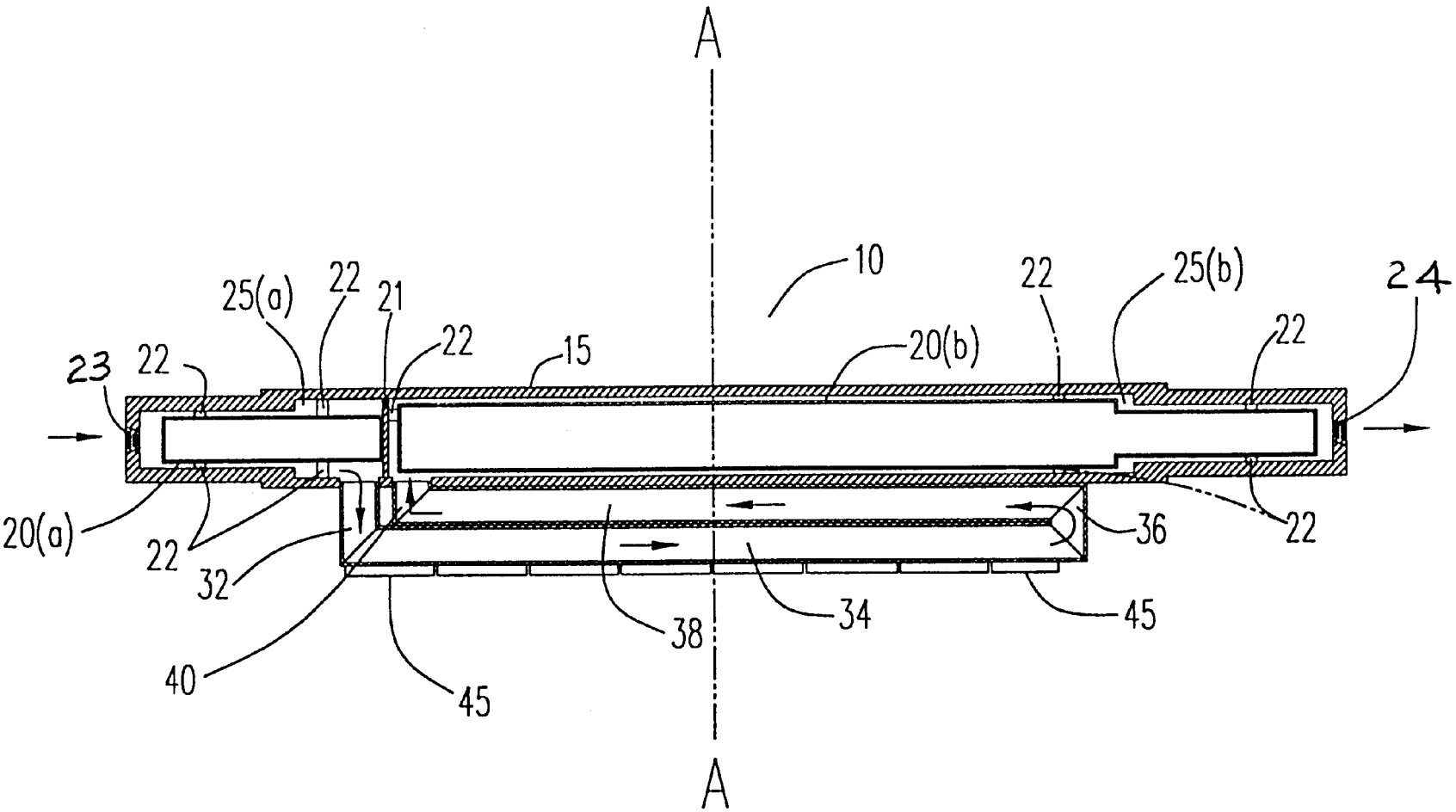
FIG. 2 is a cross sectional view of one embodiment of the water-cooled baffle of the present invention.

Referring now to the drawings, wherein like numerals indicate like elements, there is shown in the figures a water-cooled baffle 10. A first pipe 15 is fabricated from a suitable material such as carbon steel and is provided at one end with means for connecting the baffle 10 to a water source, not shown. One method of connection is a threaded water entry port 23 shown in FIG. 2. At the opposing end of first pipe 15 means are provided for the exit of the cooling water. In FIG. 2, threaded water exit port 24 is one method of connection to piping for the exit of cooling water from the baffle 10. The arrows in FIG. 2 indicate the direction of flow of cooling water or other cooling medium through the baffle 10.

The first pipe 15 as shown in the preferred embodiment has a middle section with a larger diameter than its two end sections. In this embodiment, the first pipe 15 is fabricated by joining a smaller diameter pipes comprising the end sections to each end of a comparatively larger diameter pipe to form the middle section. The first pipe may comprise a continuous pipe having a uniform diameter along the entire length. As shown in FIG. 2, a plate 21 is secured at a position inside of the first pipe 15 to block lateral flow of water through first pipe 15. The plate 21 divides the inside of first pipe 15 into a water entry end and a water exit end.

A first core buster segment 20(*a*) is disposed within the water entry end of first pipe 15. The first core buster segment 20(*a*) has a smaller outside diameter than the inside diameter of the water entry end of the first pipe 15. The first core buster segment 20(*a*) is provided with one or more water entry ports in the walls thereof to allow a filling of coolant water but without participating in the flow of coolant water along the core buster segment. One end of first core buster segment 20(*a*) is adjacent to the first side of plate 21. In alternate embodiments, first core buster segment 20(*a*) may be laterally offset from the first side of plate 21. The region between the inner surface of first pipe 15 and the outer surface of first core buster segment 20(*a*) defines a generally open annular region, or annulus 25(*a*). Spacer bars 22 may be used to space first core buster segment 20(*a*) relative to first pipe 15. All spacer bars used in the baffle 10 are kept to a minimal size to minimize interference with water flow. In the preferred embodiment, first core buster segment 20(*a*) is substantially coaxially aligned with first pipe 15. The annulus 25(*a*) conducts a predetermined minimum flow coolant water supplied to entry point 23 and selected to be sufficient to maintain solids as a suspension in the coolant water and selected to minimize the withdraw of heat from the heating chamber of the furnace.

A second core buster segment 20(*b*) is disposed within the water exit end of first pipe 15. The second core buster segment 20(*b*) is provided with one or more water entry ports in the walls thereof to allow a filling of coolant water but without participating in the flow of coolant water along the core buster segment. One end of the second buster segment 20(*b*) is adjacent to the second side of plate 21. The second core buster segment 20(*b*) has a smaller outside diameter than the inside diameter of first pipe 15. The end section of second core buster segment 20(*b*) adjacent to the water exit end of baffle 10 is smaller in diameter than its main section to conform with the smaller diameter water exit end section of first pipe 15. This preferred embodiment of second core buster segment 20(*b*) can be fabricated by joining a smaller diameter pipe to one end of a relatively larger diameter pipe forming a main section. As with first pipe 15, the first and second core buster segments may have the same diameter. The end section of second core buster segment 20(*b*) opposite the end section adjacent to the water exit end of baffle 10 is offset from the second side of plate 21 by spacer 22. In alternative embodiments, second core buster segment 20(*b*) may be adjacent to the second side of plate 21. The region between the inner surface of first pipe 15 and the outer surface of second core buster segment 20(*b*)

defines a generally open annular region, or annulus 25(*b*). Spacer bars 22 may be used to space second core buster segment 20(*b*) relative to first pipe 15. In the preferred embodiment, second core buster segment 20(*b*) is substantially coaxially aligned with first pipe 15. The annulus 25(*b*) is dimensioned to provide a flow path sufficient to maintain a predetermined minimum flow coolant water to exit point 24 and selected to be sufficient to maintain solids as an entrained suspension in the coolant water. The flow of coolant water is selected to minimize the withdraw of heat from the heating chamber of the furnace. Suitable material for the first and second core buster segments is a stainless steel alloy.

In the preferred embodiment, a duct forms a fluid cooled member that is in extension to the first pipe and preferably takes the form of a second pipe comprised of: a first end segment 32; a first longitudinal segment 34; a second end segment 36; a second longitudinal segment 38 and a third end segment 40. All segments of the second pipe have the same diameter, and the inner and outer diameters of all segments are smaller than those of first pipe 15. The axis of all segments of the second pipe and the axis of the first pipe are all substantially coplanar.

As shown in FIG. 2, first end of first end segment 32 is connected to a first opening in first pipe 15. The first opening opens into annulus 25(*a*), and is preferably located in the vicinity of the first side of plate 21. The axis of first end segment 32 is disposed at an angle to the axis of first pipe 15. First longitudinal segment 34 is connected at its first end to the second end of first end segment 32. First longitudinal segment 34 has its axis substantially parallel to the axis of first pipe 15. Second end segment 36 has its first end connected to the second end of first longitudinal segment 34. The axis of second end segment 36 is disposed at an angle to the axis of first pipe 15. Second longitudinal segment 38 is disposed between first pipe 15 and first longitudinal section 34. Second longitudinal segment 38 has its axis substantially parallel to the axis of first pipe 15. The first end of second longitudinal section 38 is connected to the second end of second end segment 36. The first end of third end segment 40 is connected to a second opening in first pipe 15. The second opening opens into annulus 25(*b*), and is preferably located in the vicinity of the second side of plate 21. The axis of third end segment 40 is disposed at an angle to the axis of first pipe 15. The second end of third end segment 40 is connected to the second end of second longitudinal segment 38. Second longitudinal end segment 38 may be solidly or intermittently joined by, for example, welds along its length, to first pipe 15 and first longitudinal end segment 34. Intermittent spacing is preferred to allow a flow path for gases between these elements.

The axis of first pipe 15, and all segments of the second pipe are coplanar. In the preferred embodiment, the second pipe is made up of five segments and alternate embodiments include a single continuous second pipe, or a different number of pipe segments that have been shaped to generally conform to the shape of the second pipe segments in the preferred embodiment. As shown in the figures, the second pipe twice traverses substantially the width of the furnace. In alternative embodiments, the second pipe may traverse substantially the width of the furnace more than the two times as in the preferred embodiment.

With the above arrangement, cooling water flows in the following manner through the baffle 10. Water enters port 23 and flows through annulus 25(*a*) then through the connected segments of the second pipe and through annulus 25(*b*) to the water exit port 24. First and second core buster segments reduce the flow path through first pipe 15 so that a minimum flow rate can be easily maintained in the annuluses 25(*a*) and 25(*b*) to ensure that solids within the water flow are kept suspended to prevent plugging in the flow path.

Figure 3:
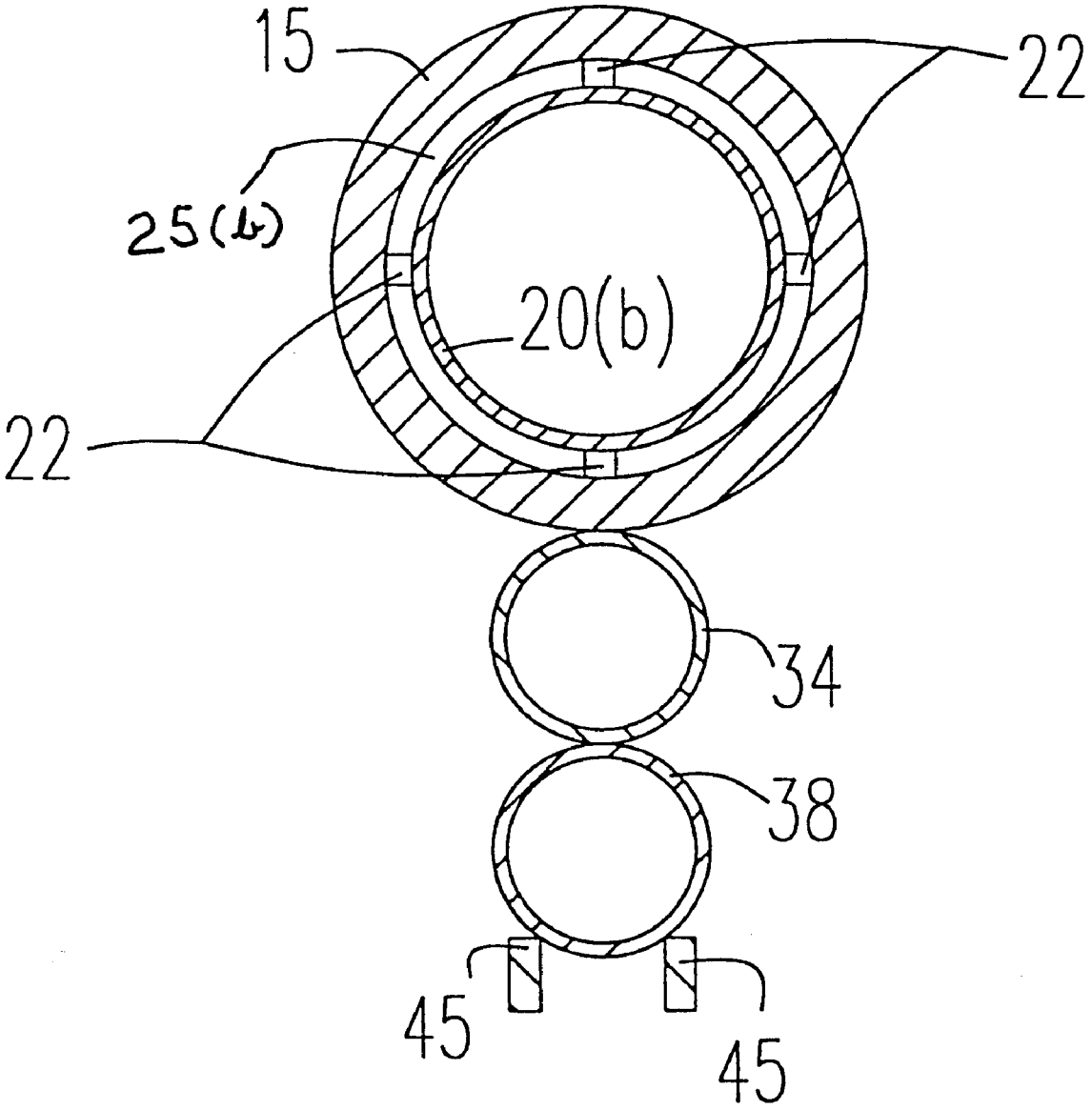
FIG. 3 is a center cross sectional view of the water-cooled baffle of the present invention as indicated by section line A—A in FIG. 2.
Figure 3A:
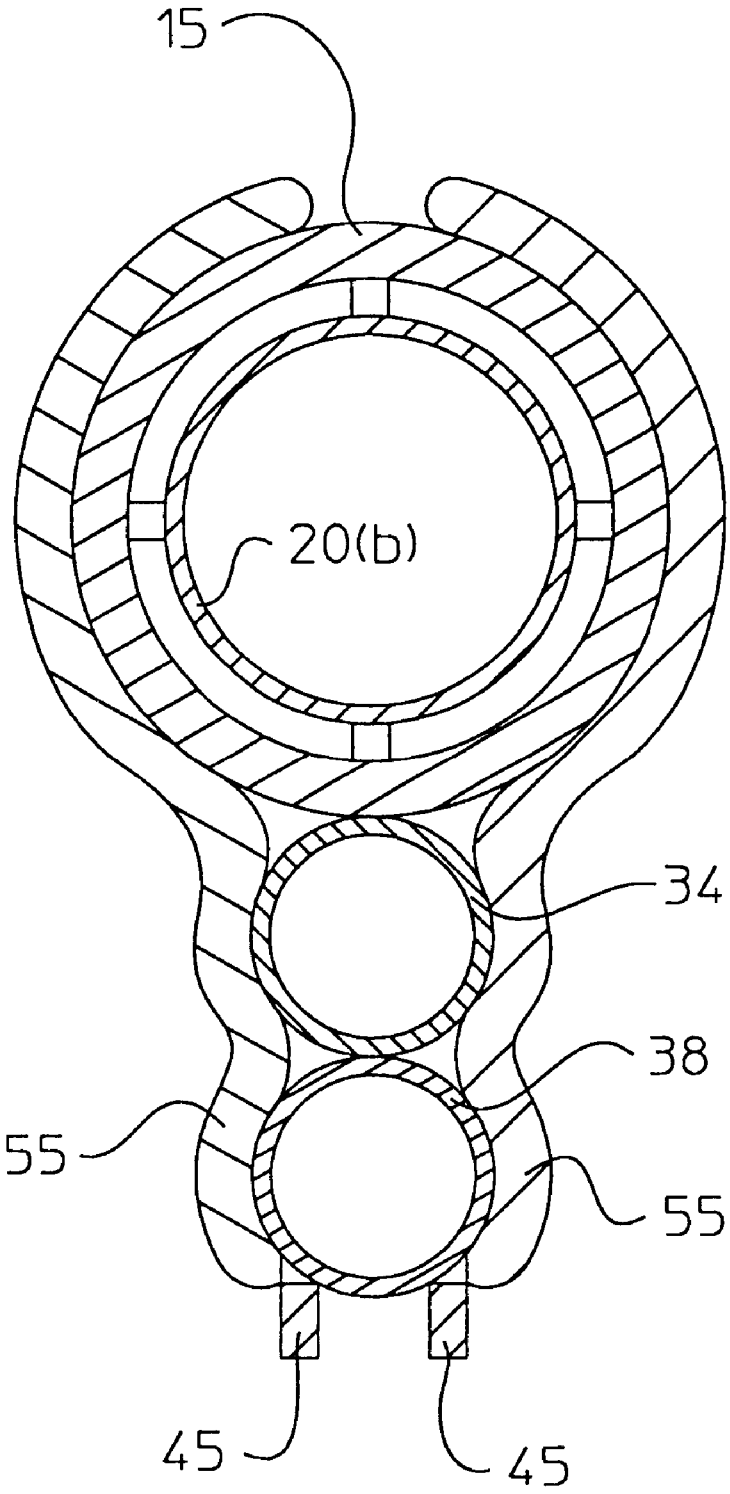

In the preferred embodiment, as best shown in FIG. 3, two substantially parallel rows of baffle skirt plates 45 extend from the bottom of the second longitudinal section 38 of the second pipe. The two rows of baffle skirt plates 45 form a double maze for better control of gas velocity under the baffle 10 which is enhanced by imparting turbulence to the gas flow. An individual skirt plate 45 is relatively short in length in comparison to the length of second longitudinal section 38, and can be fabricated from alloy steel bar. Each skirt plate is spaced apart from an adjacent skirt plate to prevent the buildup of heat between the two rows that could lead to pipe assembly distortion. In alternative embodiments, more than two rows of skirt plates can be provided. In the event it is desired particularly heat loss becomes a detrimental factor to the furnace operation, as shown in FIG. 3(*a*) the baffle 10 is covered with a layer of thermal insulation 55. The insulation 55 may comprise a blanket of ceramic fiber insulating material which has been folded into an arrangement forming deep corrugations suspended by suitable fasteners anchored to the baffle and pass through the insulating material in the folded portion most adjacent to the baffle. Thermally insulating castable material is also suitable as applied in the form of an over-lying layer on the baffle.

Figure 4A:
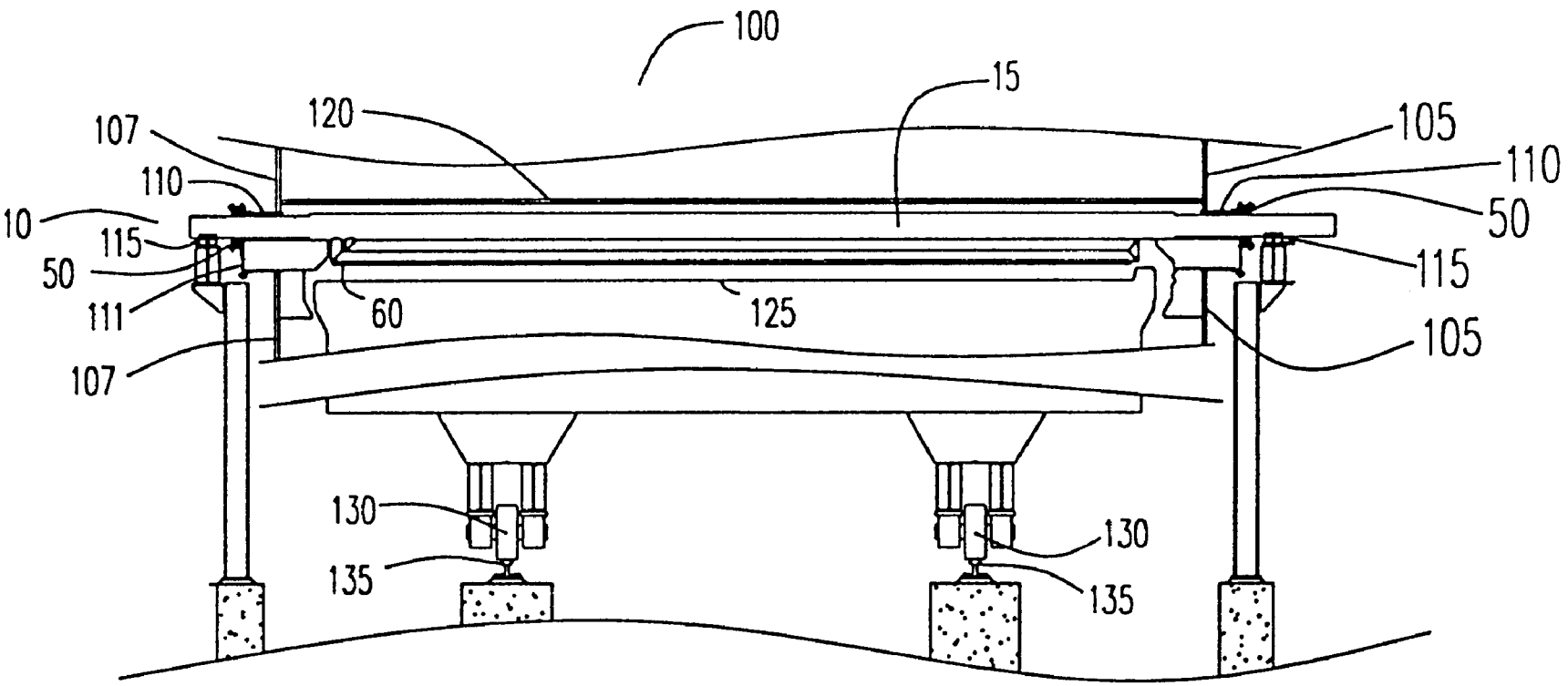
FIG. 4(*a*) is an elevational view of the water-cooled baffle of the present invention installed in a typical furnace.
Figure 4B:
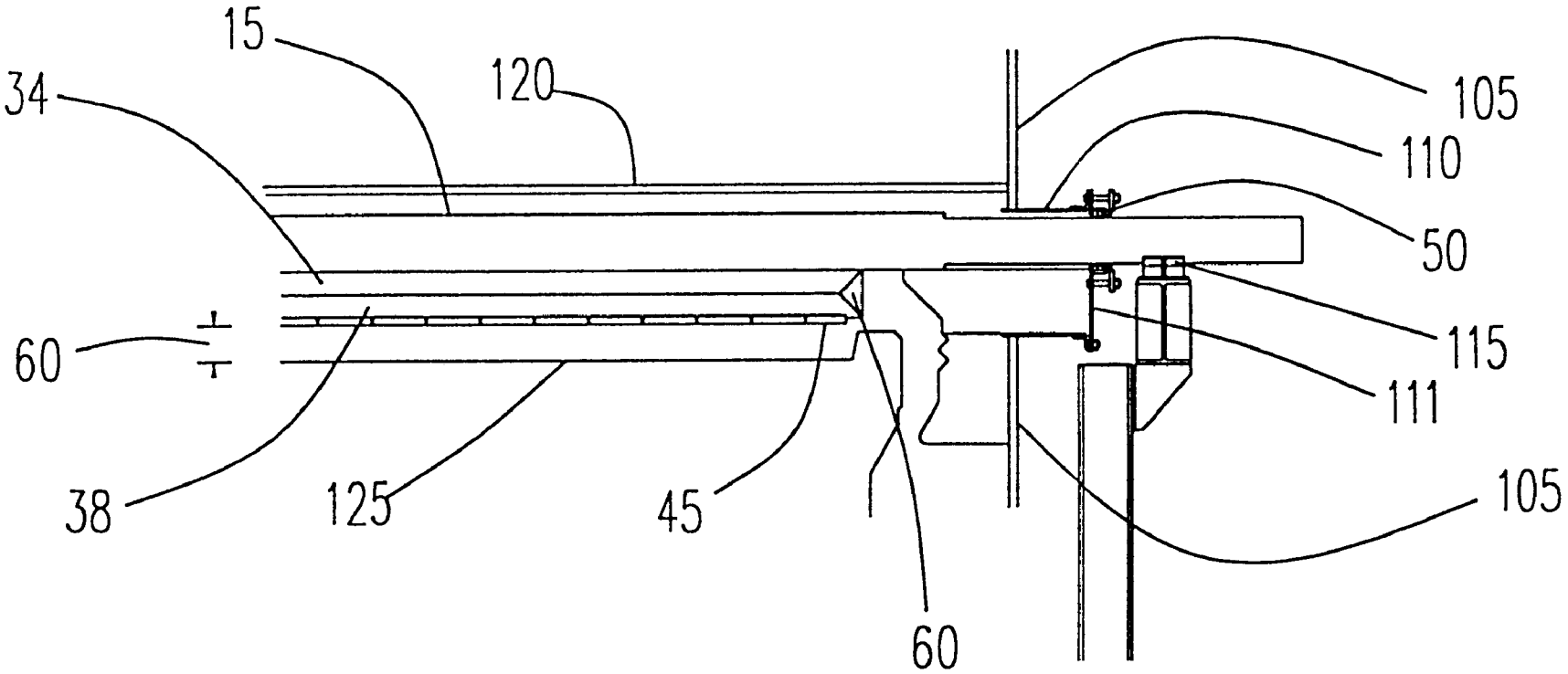

FIG. 4(*a*) shows the water-cooled baffle 10 installed in a rotary hearth furnace 100. Pertinent details of the furnace are shown in cross sectional view. As known in the art, the hearth 125 of the furnace rotates in a circular motion by connection to wheels 130 by intervening furnace structure that is not shown in the drawing. Wheels 130 are guided by rails 135. The material to be heated is placed on the hearth and transmitted through various zones of the furnace by rotation of the hearth. Baffle 10 is situated across the width of the interior of the furnace 100, typically between heating zones, or at a charge section or a discharge section. The first pipe 15 is generally disposed directly adjacent to the internal roof 120 of the furnace. Any gap between the roof 120 and the first pipe 15 of the baffle can be filled with a refractory material, such as a ceramic blanket. The first pipe 15 of the baffle serves as an arbor and extends at least to the first and second walls, 105 and 107, respectively, of the furnace. In the preferred embodiment, first pipe 15 extends through the walls to the exterior of the furnace. In the position shown in FIG. 4(*a*), the baffle 10 substantially blocks the flow of gases on either side of it, except for a flow of gasses through the gap 60 between the bottom of the baffle and the hearth 125. Skirt plates 45 are included in the baffle according to the preferred embodiment and therefore the bottom of the baffle is the bottom of the skirt plates.

In FIGS. 4(*a*) and 4(*b*), a hatch 110 is provided in furnace walls 105 and 107 to permit installation or removal of the baffle 10. In this configuration, one or more packing glands 50, formed from ceramic fiber, or other suitable material, are provided in the hatch door 111 to seal gases in the furnace. In alternate embodiments where a hatch is not provided on both walls, or no hatches are provided, the packing glands can be provided within walls 105 and 107. Suitable supports 115 are provided outside of the furnace to support first pipe 15 of the baffle. Saddle type supports are used in the preferred embodiment, although various other mounting methods known in the art could be used. The supports are connected to appropriate structural elements to a foundation.

Figure 5:
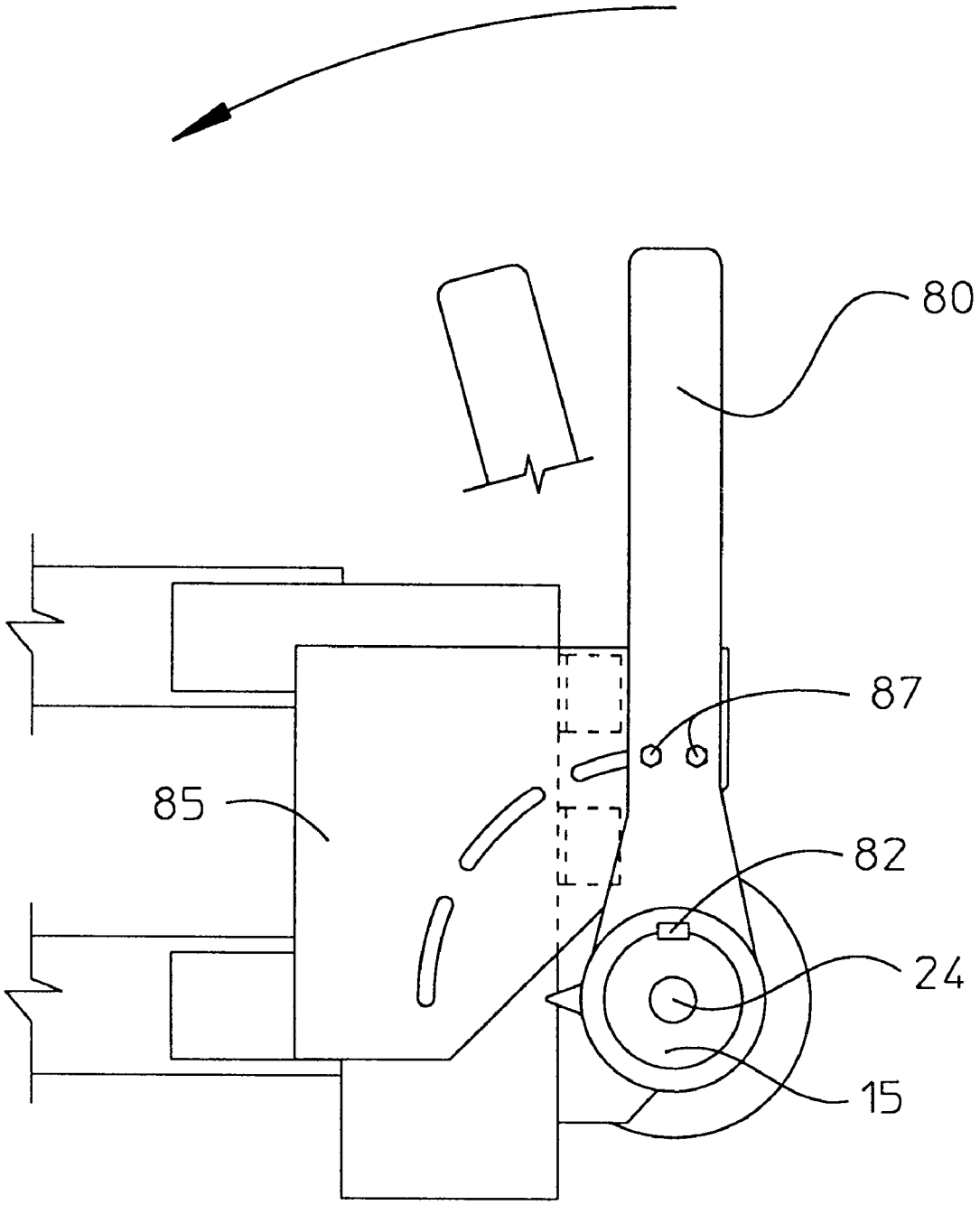
FIG. 5 is a detail of the water-cooled baffle of the present invention illustrating one embodiment for manually adjusting the operating position of the baffle.

Manual adjustment of the baffle 10 can be accomplished by mechanical means attached to first pipe 15. As shown in FIG. 5, a lever 80 is attached to one end of first pipe 15 at a position external to the furnace 100 by a key 82 in a keyway. The lever interacts with quadrant 85, so that the lever can be set with the quadrant to a selected angular operating position. A locking device, such as locking screws 87, can be provided to lock the lever in the selected position. In alternative embodiments, a motor drive can be provided for rotating first pipe 15 by either manual or automatic control.

In one particular embodiment of the invention, with a first pipe 15 having a nominal outer diamond of approximately 8 inches, and all segments of the second pipe having a nominal outer diameter of approximately 3 inches, with a 23-foot wide furnace, clearance gap 60 was adjusted between the bottom of baffle 10 and the hearth 125 of the furnace 100 for various angular degrees of position as shown in the following table.

| Angular Degrees Open | Gap (inches) |
|---|---|
| 0 | 7/8 |
| 10 | 15/16 |
| 15 | 1 1/16 |
| 20 | 1 3/8 |
| 25 | 1 13/16 |
| 30 | 2 3/8 |
| 35 | 3 |
| 40 | 3 7/8 |
| 45 | 4 3/4 |
| 50 | 5 3/4 |
| 55 | 7 1/16 |
| 60 | 8 1/2 |
| 90 | 9 3/8 |

The bottom of the baffle 10 is defined as the bottom of plate skirts 45 when the baffle 10 is in the "zero degrees" position, as shown in FIG. 4(*a*). "Zero degrees" open refers to the position of the baffle 10 when the plane in which the axes of the first pipe 15 and all segments of the second pipe substantially lie is substantially perpendicular to the roof 120 and hearth 125 of the furnace 100. In this position, maximum blocking of gas flow on both sides of the baffle is achieved. If plate skirts 45 are not used, the bottom of the baffle 10 is defined as the outer surface of the second longitudinal segment 34 that is the closest to the hearth in the "zero degrees" position. The "90 degrees" open position refers to the position of the baffle 10 when the plane of the axes of the first and second pipes is substantially parallel to the roof 120 and hearth 125 of the furnace. Positions between zero and 90 degrees lie between these two extremes. Baffle rotation may be in one direction relative to vertical "zero degrees" position, or in two directions, for rotation to either a plus or minus "90 degrees" position. The artisan will appreciate that varying diameters of first and second pipes can be used for furnaces of different widths without departing from the disclosed invention.

Although the preferred embodiment of the water-cooled baffle plate 10 is disclosed with the use of substantially cylindrical pipes, the artisan will appreciate that alternative forms performing the same functions, such as rectangular elements, can be used to practice the invention.

The present invention may be embodied in other specific forms without departing from the spirit or essential attributes thereof. Accordingly, reference should be made to the appended claims, rather than to the foregoing specification, as indicating the scope of the invention.

What is claimed is:

1. A fluid-cooled baffle comprising:

a first pipe having a fluid entry port at a first end and a fluid exit port at a second end;

a plate disposed within said first pipe to block the flow of fluid through said first pipe;

a first core buster segment disposed within said first pipe between said fluid entry port and a first side of said plate, whereby a substantially annular first region is formed between the inner surface of said first pipe and the outer surface of said first core buster segment;

a second core buster segment disposed within said first pipe between said fluid exit port and a second side of said plate, whereby a substantially annular second region is formed between the inner surface pipe and the outer surface of said second core buster segment; and a duct having a first end connected to a first opening in said first pipe between said fluid entry port and said first side of said plate and a second end connected to a second opening in said first pipe between said second side of said plate and said fluid exit port;

whereby a continuous flow path for fluid is provided from said fluid entry port, through said first region, said second pipe, and said second region to said fluid exit port.

2. The fluid-cooled baffle of claim 1 further comprising at least two rows of baffle skirt plates connected to the bottom of said second pipe.

3. The fluid-cooled baffle of claim 2 wherein each row of said at least two rows of baffle skirt plates is a plurality individual plates spaced apart from each other.

4. The fluid-cooled baffle of claim 1 wherein said duct further comprises:

a first end segment having a first end and a second end, and an axis disposed at an angle to the axis of said first pipe, said first end segment connected at said first end to said first opening;

a first longitudinal segment having a first end and a second end, and an axis disposed substantially parallel to the axis of said first pipe, said first end connected to said second end of said first end segment;

a second end segment having a first end and a second end, and an axis disposed at an angle to the axis of said first pipe, said second end segment connected at said first end to said second end of first longitudinal segment;

a second longitudinal segment having a first end and a second end, and an axis disposed substantially parallel to the axis of said first pipe, said first end connected to said second end of said second end segment; and a third end segment having a first end and a second end, and an axis disposed at an angle to the axis of said first pipe, said third end segment connected at said first end to said second end of second longitudinal segment and said second end connected to said second opening.

5. The fluid-cooled baffle of claim 1 wherein said duct defines a fluid flow cross sectional area which is smaller than the diameter of the inner surface of said first pipe.

6. The fluid-cooled baffle of claim 1 wherein said first opening is located in the vicinity of said first side of said plate.

7. The fluid-cooled baffle of claim 1 wherein said second opening is located in the vicinity of said second side of said plate.

8. The fluid-cooled baffle of claim 1 further including a layer of thermal insulation material support by said first pipe and said duct.

9. A fluid-cooled baffle for controlling the clearance gap between said baffle and the hearth of a furnace, the baffle comprising:

a rotatable first pipe having a fluid entry port at a first end and a fluid exit port at a second end, said first pipe substantially horizontally disposed below the roof of said furnace and extending to at least opposing walls of said furnace;

a plate disposed within said first pipe to block the flow of fluid through said first pipe;

a first core buster segment disposed within said first pipe between said fluid entry port and a first side of said plate, whereby a substantially annular first region is formed between the inner surface of said first pipe and the outer surface of said first core buster segment;

a second core buster segment disposed within said first pipe between said fluid exit port and a second side of said plate, whereby a substantially annular second region is formed between the inner surface pipe and the outer surface of said second core buster segment; and a duct having its first end connected to a first opening in said first pipe between said fluid entry port and said first side of said plate, and second end connected to a second opening in said first pipe between said second side of said plate and said fluid exit port, said second pipe traversing substantially twice at least twice the width of said furnace;

whereby a continuous flow path for fluid is provided from said fluid entry port, through said first region, said second pipe, and said second region to said fluid exit port.

10. The fluid-cooled baffle of claim 9 further comprising at least two rows of baffle skirt plates connected to the bottom of said second pipe.

11. The fluid-cooled baffle of claim 10 wherein each of the at least two rows of baffle skirt plates is a plurality of individual plates spaced apart from each other.

12. The fluid-cooled baffle of claim 9 wherein the second pipe further comprises:

a first end segment having a first end and a second end, and an axis disposed at an angle to the axis of said first pipe, said first end segment disposed in proximity of the first said wall of said furnace, said first end segment connected at said first end to said first opening;

a first longitudinal segment having a first end and a second end, and an axis disposed substantially parallel to the axis of said first pipe, said first end connected to said second end of said first end segment, said first longitudinal segment traversing substantially the width of said furnace;

a second end segment having a first end and a second end, and an axis disposed at an angle to the axis of said first pipe, said second end segment disposed in proximity of said second wall of said furnace, said second end segment connected at said first end to said second end of first longitudinal segment;

a second longitudinal segment having a first end and a second end, and an axis disposed substantially parallel to the axis of said first pipe, said first end connected to said second end of said second end segment, said second longitudinal segment traversing substantially the width of said furnace; and a third end segment having a first end and a second end, and an axis disposed at an angle to the axis of said first pipe, said first end segment disposed adjacent to said first end segment, said third end segment connected at said first end to said second end of second longitudinal segment and said second end connected to said second opening.

13. The fluid-cooled baffle of claim 9 wherein said second pipe is smaller in diameter than said first pipe.

14. The fluid-cooled baffle of claim 9 wherein said first opening is located in the vicinity of said first side of said plate.

15. The fluid-cooled baffle of claim 9 wherein said second opening is located in the vicinity of said second side of said plate.

16. The fluid-cooled baffle of claim 9 further comprising manual means to rotate said first pipe, whereby said clearance gap between said baffle and said hearth can be adjusted.

17. The baffle of claim 16 wherein said manual means to rotate said first pipe comprises a lever connected to said first pipe.

18. The baffle of claim 9 further comprising automatic means to rotate said first pipe, whereby said clearance gap between said baffle and said hearth can be adjusted.

19. The fluid-cooled baffle of claim 9 further including a layer of thermal insulation material support by said first pipe and said duct.

* * * * *